US005778589A

United States Patent [19]

Teague

[11] Patent Number: 5,778,589

[45] Date of Patent: Jul. 14, 1998

[54] ADJUSTABLE GUN SUPPORT

[76] Inventor: Rocky Lane Teague, St. Rte. 1, Box 5801, Three Rivers, Tex. 78071

[21] Appl. No.: 840,023

[22] Filed: Apr. 24, 1997

[51] Int. Cl.[6] ..... F41A 31/00

[52] U.S. Cl. ..... 42/94; 89/37.01

[58] Field of Search ..... 42/94; 89/37.01

[56] References Cited

U.S. PATENT DOCUMENTS

| | | | |
|---|---|---|---|
| 664,979 | 1/1901 | Taylor | 42/94 |
| 759,593 | 5/1904 | Cover | 42/94 |
| 784,390 | 3/1905 | Dunham | 42/94 |
| 897,577 | 9/1908 | Bourne | 42/59 |
| 2,826,848 | 3/1958 | Davies | 42/71 |
| 3,225,656 | 12/1965 | Flaherty et al. | 89/37 |
| 3,313,505 | 4/1967 | Petrie | 248/165 |
| 3,963,156 | 6/1976 | Perrin | 224/1 R |
| 4,575,964 | 3/1986 | Griffin | 42/94 |
| 4,676,021 | 6/1987 | Groba | 42/94 |
| 5,070,636 | 12/1991 | Mueller | 42/94 |
| 5,074,188 | 12/1991 | Harris | 89/37.04 |
| 5,149,900 | 9/1992 | Buck | 42/94 |
| 5,180,874 | 1/1993 | Troncoso, Jr. | 42/72 |

*Primary Examiner*—Charles T. Jordan
*Assistant Examiner*—Meena Chelliah
*Attorney, Agent, or Firm*—David G. Henry

[57] ABSTRACT

The invention is of an adjustable and portable gun support which is useful primarily for supporting and accurately sighting high powered rifles. The gun support includes a support cradle for a user's trigger arm forearm, as well as for the barrel of the gun being used. All features of the gun support are adjustable whereby the relative positions and orientations of a user and the gun may be adjusted to virtually any desired configuration.

2 Claims, 7 Drawing Sheets

ADJUSTABLE GUN SUPPORT

BACKGROUND OF THE INVENTION

1. Field of The Invention

Applicant's invention relates to armaments and accessories therefor.

2. Background Information

The present invention is primarily intended for use by hunters, but also has utility for police and military users as well.

To achieve a high degree of accuracy when shooting a rifle over a long distance, some form of support for the rifle is needed. No person is able to remain perfectly still while supporting the weight of a rifle, and the ability to immovably support the rifle rapidly degrades over other than a nominal period of time.

When the user of a rifle wants to assume and hold a particular sighting, he or she will often "prop" the gun barrel on some available surface. This is usually a far from adequate (or at least comfortable) option. The edge of a deer blind wall, for example, will rarely be at the precise height desired, and the hunter will usually have to "squat down" or otherwise assume some uncomfortable stance to properly align the angle of sight with the desired rifle orientation. In addition, any support for the rearmost user's arm is improvised, at best.

SUMMARY OF THE INVENTION

It is an object of the present invention to provide a novel gun support.

It is another object of the present invention to provide a novel gun support which facilitates steady holding and sighting of guns.

It is another object of the present invention to provide a novel gun support the use of which reduces fatigue of its user.

It is another object of the present invention to provide a novel, adjustable gun support which is portable.

It is yet another object of the present invention to provide a novel gun support which adjustably supports a rifle barrel and the user's trigger arm.

In satisfaction of these and related objectives, the present invention provides an adjustable gun support, principally for use with high powered rifles. The gun support of the present invention is designed to support a rifle in precisely a desired orientation, when the user is standing or sitting in a comfortable position.

The gun support provides support for both the trigger arm of the user and a rifle barrel. Every linkage in the gun support is somehow adjustable, whereby virtually any relative position between the user and the supported rifle may be achieved.

The gun support is designed for easy portability. In this respect, the gun support collapses from its use configuration to a highly compact, easily transported configuration.

BRIEF DESCRIPTION OF THE DRAWINGS

Applicant's invention may be further understood from a description of the accompanying drawings wherein, unless otherwise specified, like reference numbers are intended to depict like components in the various views.

DETAILED DESCRIPTION OF THE PREFERRED EMBODIMENT

Figure 1:
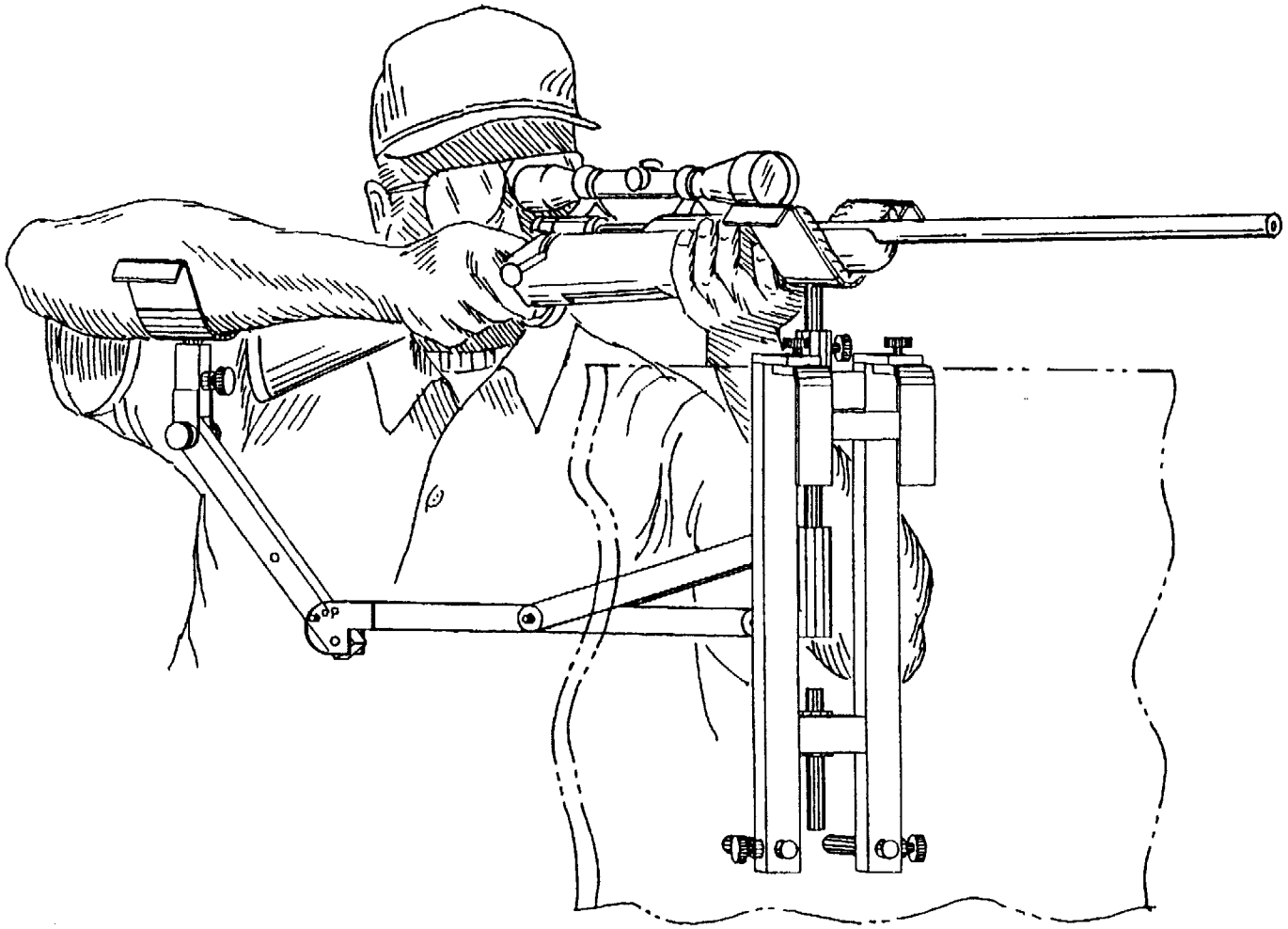
FIG. 1 is a perspective view of the gun support of the present invention in use.
Figure 2:
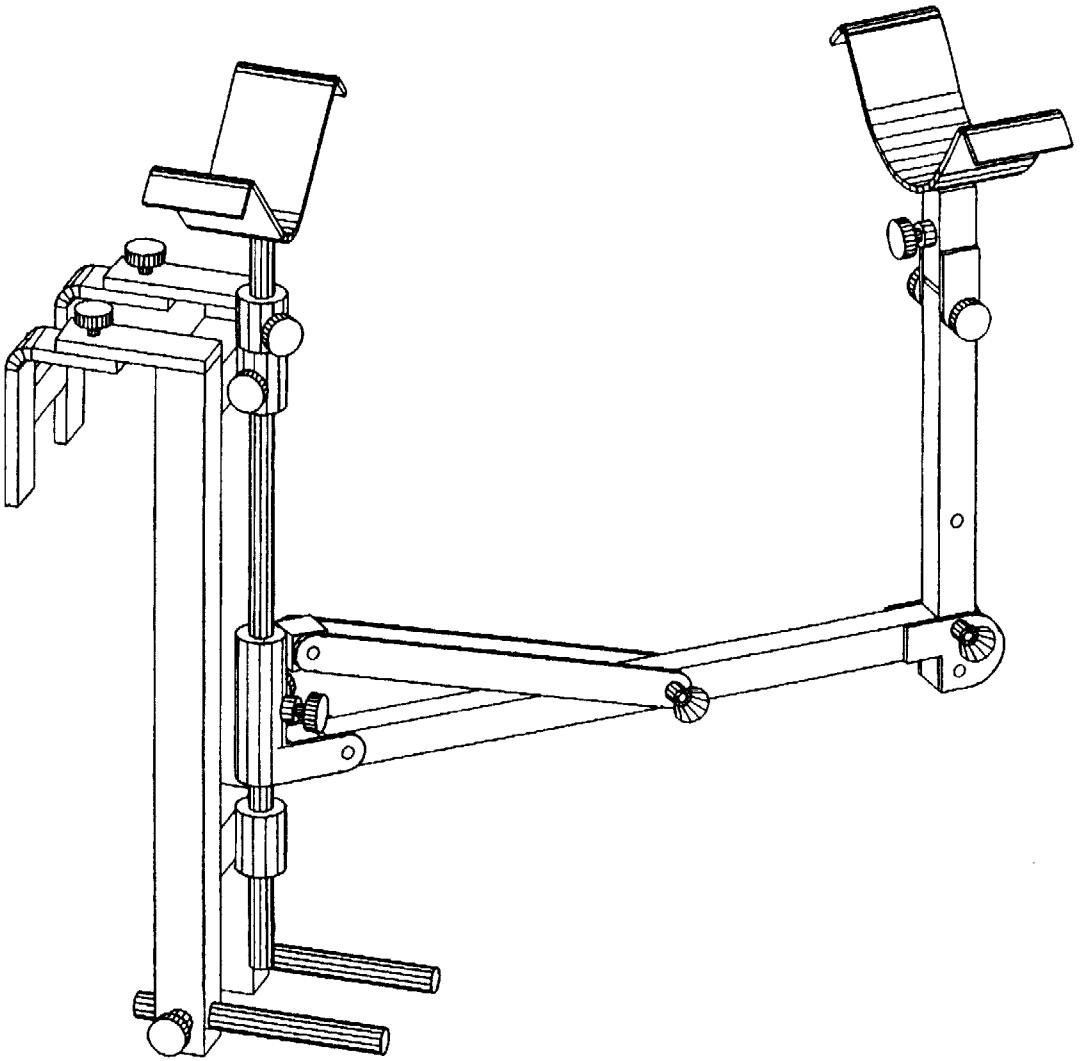
FIG. 2 is a perspective view of the preferred embodiment of the gun support of the present invention.
Figure 4:
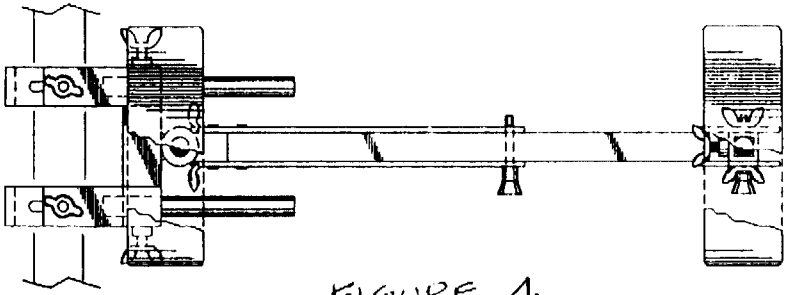
FIG. 4 is a top plan view of the gun support of FIGS. 1 and 2.

Referring principally to FIGS. 1 and 2, the gun support of the present invention is identified generally by the reference number 10. A gun support frame 12 is the platform to which all utilitarian elements of gun support 10 are attached.

An arm cradle support 14 supports an arm cradle 16. Arm cradle 16 is intended to support the forearm of a user's trigger arm at a desired height and orientation relative to the gun support frame 12, and through its support of the barrel of the gun in use, to the gun.

Extending upwards from frame 12 is a barrel cradle 18 which is for supporting the barrel of a gun (usually a rifle) at any desired height or orientation, relative to the gun support frame 12.

A frame hanger assembly 20 extends from gun support frame 12, and, in the preferred embodiment, is designed to engage a substantially horizontally orientated, upper margin of some mounting surface, usually a vertical standing surface (a well, window sill, etc.).

Frame levelers 22 are movably attached to gun support frame 12 to orient the gun support frame relative to the mounting surface.

Figure 3:
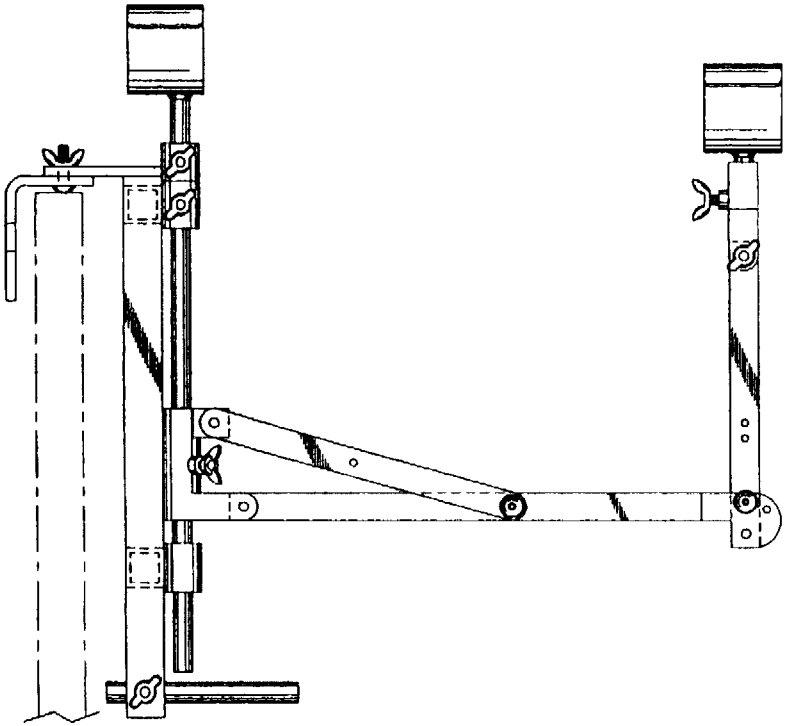
FIG. 3 is an elevational side view of the gun support of FIGS. 1 and 2 where an exemplary mounting surface is depicted in hashed lines.
Figure 5:
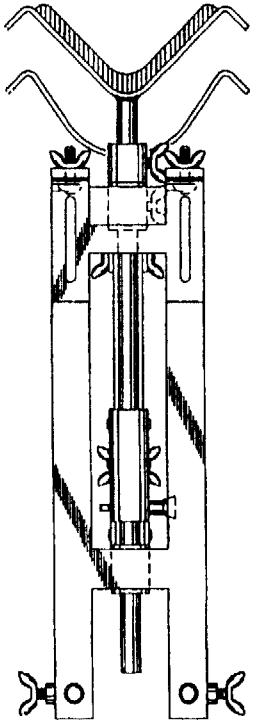
FIG. 5 is an elevational rear view of the gun support of FIGS. 1 and 2.
Figure 6:
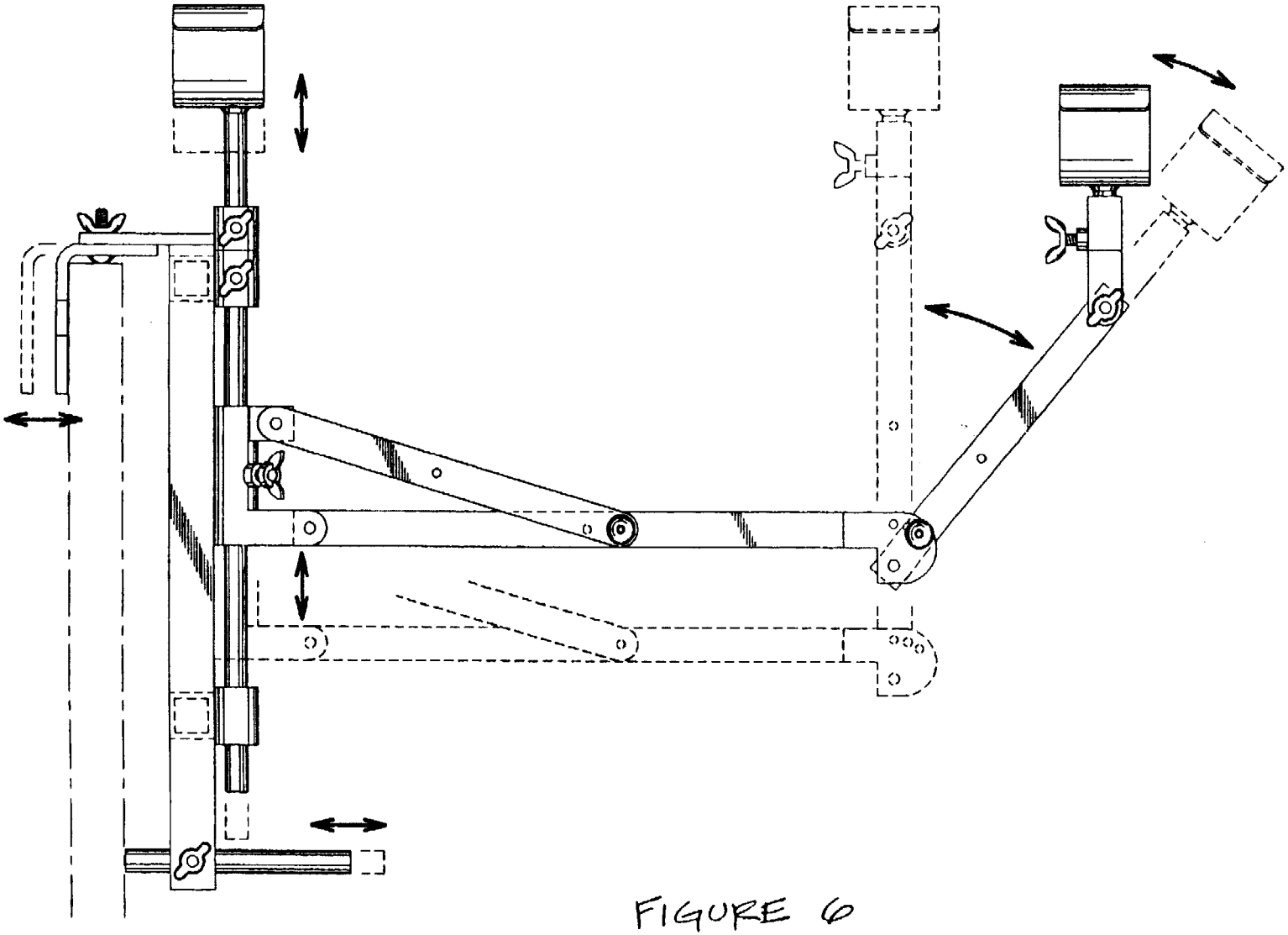
FIG. 6 is an elevational side view of the gun support of FIGS. 1 and 2 which side view depicts the ranges of motion available for the arm cradle support, barrel cradle, frame hanger assembly, and frame levelers.
Figure 7:
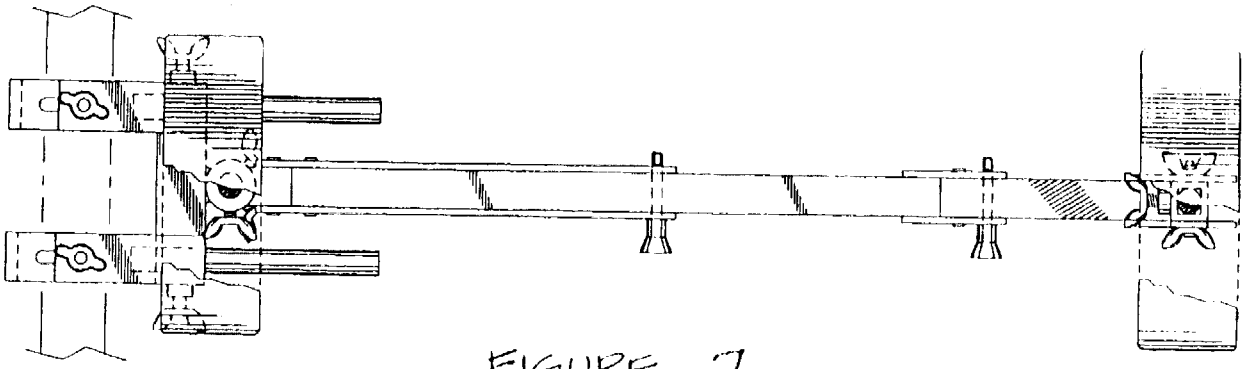
FIG. 7 is a top plan, partially cut-away view of the gun support of FIGS. 1 and 2.
Figure 8:
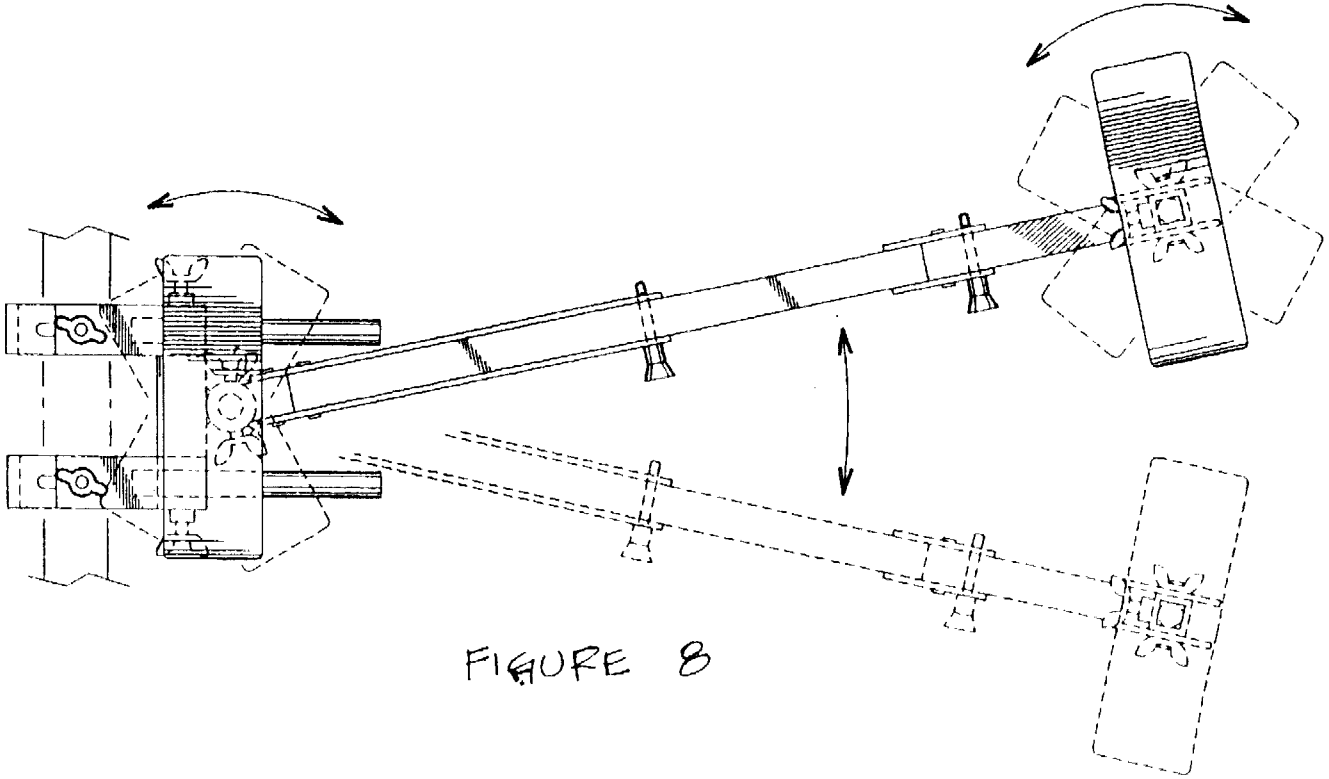
FIG. 8 is a top plan, partially cut-away view of the gun support of FIGS. 1 and 2 showing the range-of-motion for the arm cradle, barrel cradle, and arm cradle support of the preferred embodiment.
Figure 9:
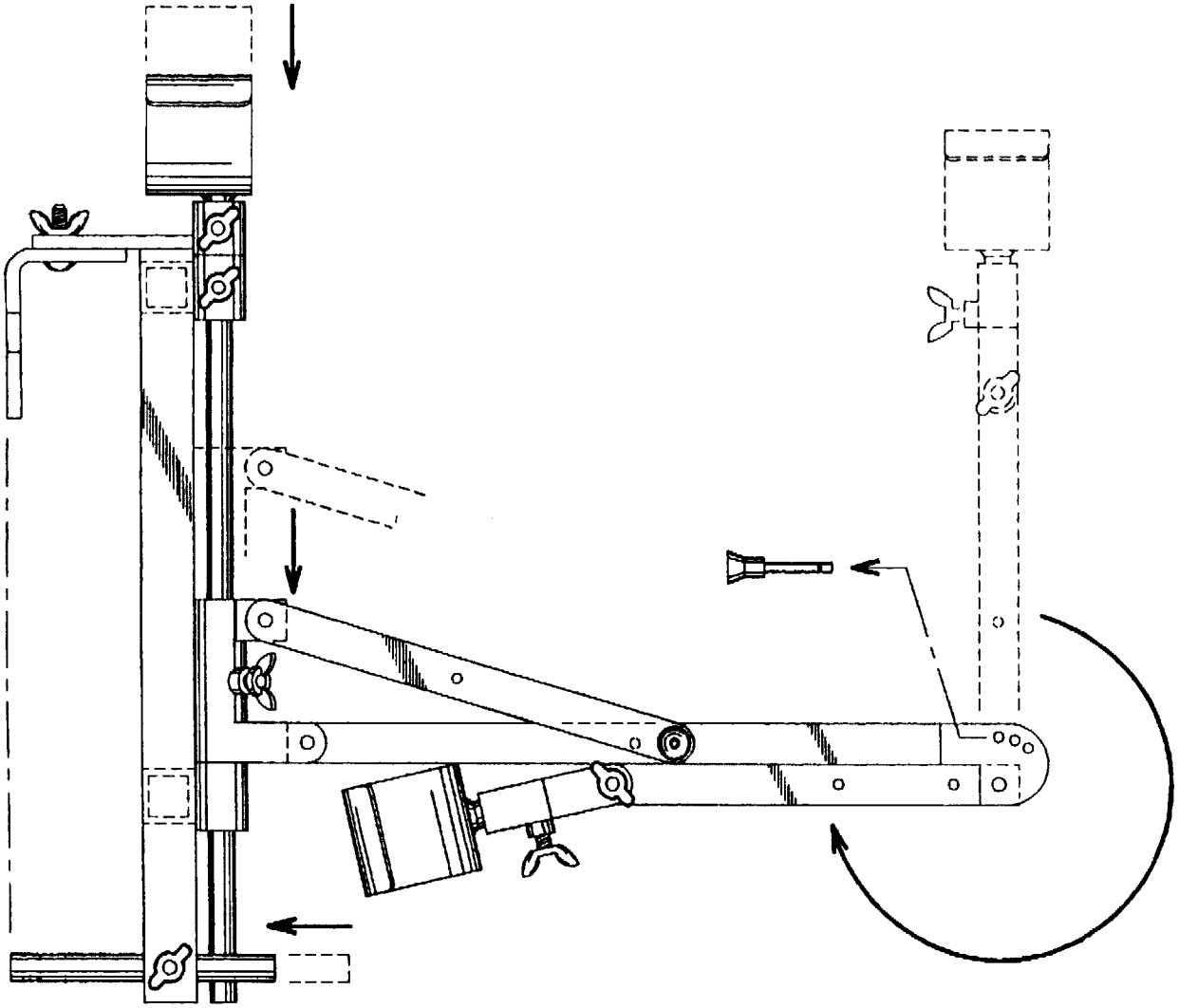
FIG. 9 is an elevational side view of the gun support of FIGS. 1 and 2 showing the range-of-motion of beams of the arm cradle support and barrel cradle.
Figure 10:
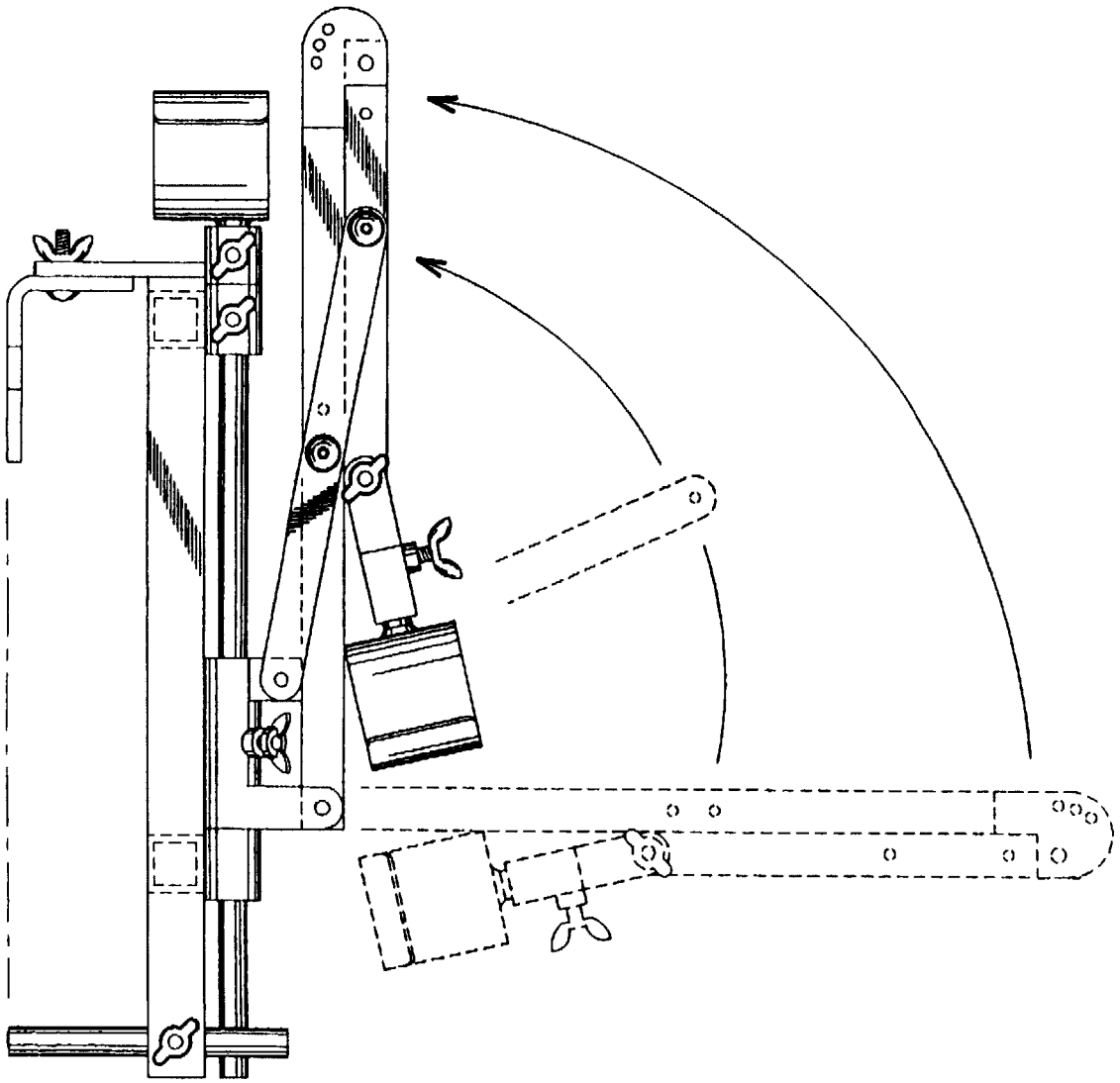
FIG. 10 is an elevational side view of the gun support of FIGS. 1 and 2 showing the range-of-motion of the arm cradle support relative to cradle support rod and of the barrel cradle relative to the gun support frame.

Referring principally to FIGS. 3, 6, 7, 8, 9 and 10, arm cradle support 14 is, in the preferred embodiment, an adjustable, collapsible structure which extends between several use configurations (FIGS. 1, 2, 3, and 6) and compact configurations (FIGS. 9 and 10). Arm cradle support 14 includes an elbow assembly 24 which pivotally joins its proximal beam 26 and distal beam 28, and permits, through use of locking pins 30, the locking of arm cradle support 14 in several configurations. These configurations include, at least, the compact configuration (FIG. 11) and several use configurations (FIGS. 3 and 6).

Arm cradle support 14 is pivotally attached to an arm cradle support collar 32 which, in turn, is both pivotally and slidably attached to an arm cradle support rod 34 which forms part of gun support frame 12. Arm cradle support 14 is, thus, adjustable relative to the gun support frame 12 (and any mounting surface to which it is attached) in a vertical, linear fashion, in a vertical arcual fashion, and in a lateral arcual fashion. This flexibility of orientation means that the user's forearm of the trigger arm can be comfortably supported in virtually any reasonable orientation relative to the gun support frame 12 and the gun.

Referring principally to FIGS. 1, 2, 3, and 8, arm cradle 16 is rotatably attached to the arm cradle end of arm cradle support 14. This feature is for accommodating the differing forearm orientations (relative to the gun) which any plurality of users might exhibit. Arm cradle 16 may be rotated to align its mid-line with the user's arm, and locked into the desired orientation through use of set-screw 36.

Referring principally to FIGS. 1, 2, 3, 5, 6 and 9, barrel cradle 18 is, in the preferred embodiment, affixed to the upper end of arm cradle support rod 34. Arm cradle support rod 34 is telescopically and rotatably interfaced with rod collar 38. Thus, barrel cradle 18 is rotatable (see FIG. 8) and extendable upwards and downwards (see FIG. 6) relative to gun support frame 12. Barrel cradle 18 may be locked into position (vertically and laterally) through use of set screw 40.

Referring principally to FIGS. 3 and 6, frame hanger assembly 20 of the preferred embodiment is designed to accommodate mounting structures of differing thicknesses. Hanger clasp 42 slides relative to hanger mount 44, and is locked into a desired position through use of locking bolt 46. Frame levelers 22 extend telescopically through the gun support frame 12, and are held in a desired degree of extension or retraction by set screws 48. Thus, even if the mounting structure does not exhibit a planer, vertical surface upon which the levelers may rest, the gun support frame 12 may be aligned with the vertical through use of levelers 22.

Referring to FIGS. 9 and 10, the portability of the preferred embodiment of the present invention is a highly desirable feature. As depicted, arm cradle support 14 easily collapses to a quite compact configuration, and barrel cradle 18 is likewise retractable. Locking pin 30 is used to lock arm cradle support 14 in its storage or transport configuration.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. An adjustable gun support comprising:

a collapsible arm cradle support which is adjustable between an extended position whereby said cradle arm assumes an elongate configuration, and a compact position wherein said arm cradle support assumes a compact, folded configuration, said arm cradle support having a cradle end and a frame end;

an arm cradle adjustably attached to said cradle end of said arm cradle;

a gun support frame adjustably attached to said frame end of said arm cradle support;

a barrel cradle adjustably attached to said gun support frame;

frame hanger means for reversibly suspending said gun support frame from a mounting surface;

frame leveling means for adjusting the orientation of said gun support frame relative to said mounting surface.

2. The gun support of claim 1 wherein said collapsible cradle arm is adjustable between a plurality of said extended elongate configurations and said compact, folded configuration.

* * * * *